United States Patent [19]

Kalis, Jr.

[11] 4,170,119

[45] Oct. 9, 1979

[54] PADDLE HANDLE LOCK BOLT

[75] Inventor: George Kalis, Jr., Brunswick, Ohio

[73] Assignee: The Scott & Fetzer Company Stahl Division, Cleveland, Ohio

[21] Appl. No.: 875,234

[22] Filed: Feb. 6, 1978

[51] Int. Cl.[2] ..... E05C 1/14; E05B 13/00

[52] U.S. Cl. ..... 70/221; 70/149; 70/DIG. 31; 292/173; 292/DIG. 27; 292/DIG. 31

[58] Field of Search ..... 292/173, 143, DIG. 27, 292/DIG. 30, DIG. 31; 70/221, 222, 224, 218, 207, 149, 489, DIG. 31, DIG. 67

[56] References Cited

U.S. PATENT DOCUMENTS

| | | | |
|---|---|---|---|
| 2,274,455 | 2/1942 | Murphy | 70/149 |
| 2,978,895 | 4/1961 | Heisler | 70/221 X |
| 3,449,005 | 6/1969 | Pastua, Jr. | 292/173 |
| 3,587,259 | 6/1971 | Sandor | 70/218 |
| 3,707,862 | 1/1973 | Pastua, Jr. | 292/DIG. 31 X |

FOREIGN PATENT DOCUMENTS

| | | | |
|---|---|---|---|
| 135399 | 9/1947 | Australia | 70/149 |
| 508561 | 12/1954 | Canada | 292/DIG. 31 X |
| 717308 | 2/1942 | Fed. Rep. of Germany | 70/221 |

*Primary Examiner*—Roy D. Frazier
*Assistant Examiner*—William E. Lyddane
*Attorney, Agent, or Firm*—Pearne, Gordon, Sessions, McCoy & Granger

[57] ABSTRACT

A paddle handle lock bolt includes a bellcrank retractor or trigger member which constitutes the central element of a three element drive train comprising a paddle handle, the bellcrank retractor, and a spring-loaded slide bolt. The bellcrank retractor can be selectively coupled to the paddle handle for selectively drivingly engaging the spring-loaded slide bolt in the retracting direction.

4 Claims, 5 Drawing Figures

PADDLE HANDLE LOCK BOLT

Flush type paddle handle lock bolts are useful in a number of applications. There has consequently been a continuing need for improved designs which achieve a better balance of relatively low material and manufacturing costs, ease of operation, reliability, and effectiveness. From the standpoint of effectiveness, a particular consideration is the vulnerability of the lock to forcing. Many paddle handle lock bolts of even the best designs in most of the foregoing respects are nevertheless vulnerable to forcing. While locks which cannot be forced have been long provided, as seen for example in U.S. Pat. Nos. 2,978,895 to Heisler and U.S. Pat. 3,587,259 to Sandor, lock bolts of the flush or paddle handle type or similar thereto have generally been subject to forcing, as for example the locks seen in U.S. Pat. Nos. 3,782,141 to Doerrfeld and U.S. Pat. 3,871,198 to Miller.

The present invention provides a flush type paddle handle lock bolt of simple design which can be economically manufactured, is easy to operate, is reliable and effective, and which in particular cannot be forced.

The invention involves the concept of providing a linkage including a bellcrank or trigger which, although somewhat similar to the twin "latch fingers 25" shown in aforementioned U.S. Pat. No. 2,978,895 to Heisler, is laterally centrally located and utilized not as a latch finger but as the central member of a three element bolt-retraction train comprising the paddle handle, the bellcrank, and a sliding bolt. The result is a compact, simple, reliable force-proof flush type paddle handle lock bolt.

These and other objects and advantages of the invention will be better understood from the following description of one specific example of the invention.

Figure 1:
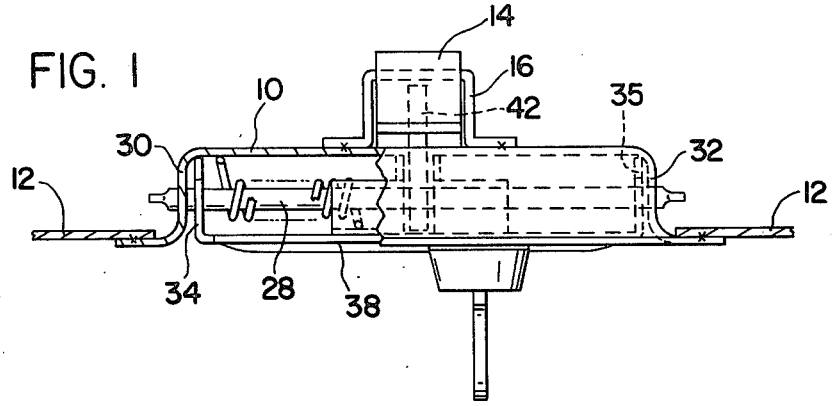
FIG. 1 is an end view, partly broken away, of a flush type paddle handle lock bolt embodying the invention.
Figure 2:
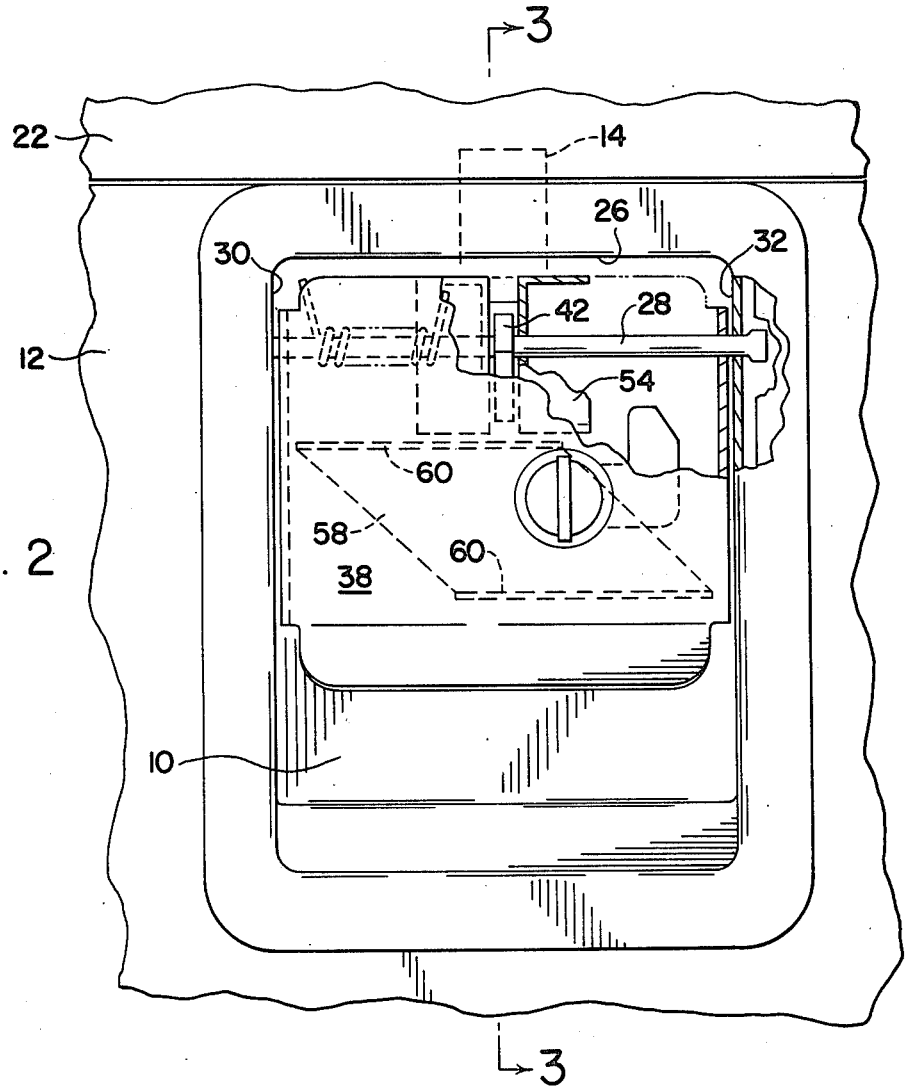
FIG. 2 is a front view of the same lock bolt.
Figure 3:
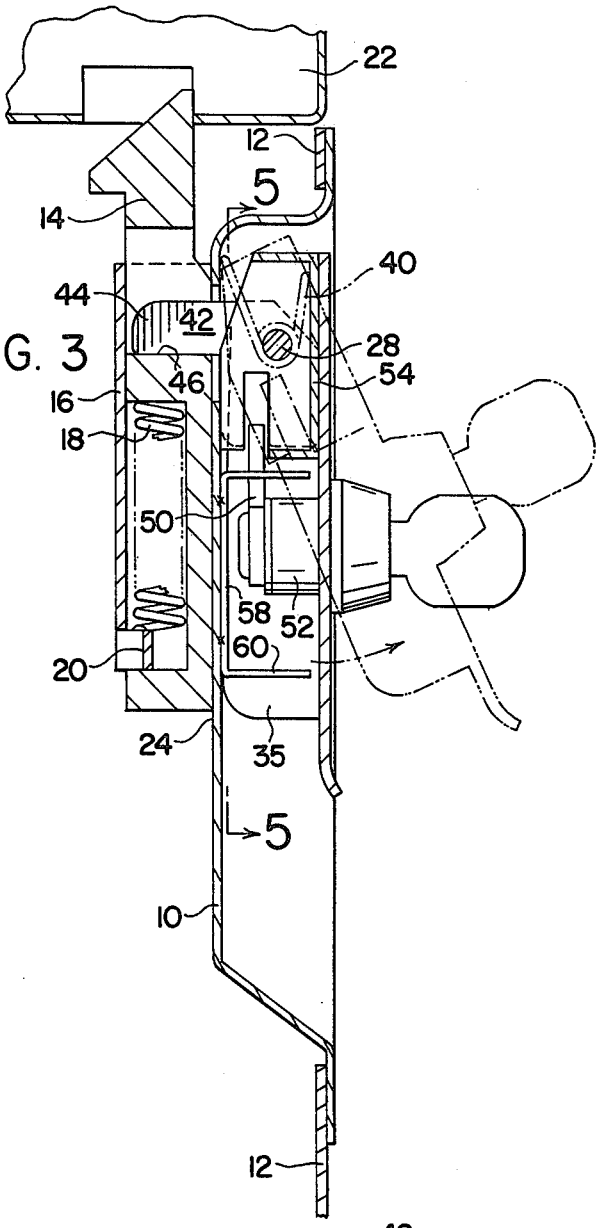
FIG. 3 is a section taken on the plane of line 3—3 in FIG. 2, and also showing the parts in an alternate position in the locked condition of the lock bolt.

The flush type paddle handle lock bolt shown in the drawings include a paddle handle frame pan 10 which may be mounted in the wall 12 of a vehicle door or the like. A spring loaded bolt 14 is mounted on the outer bottom of the pan 10 within a guide channel 16. The bolt 14 is slotted to receive a compression spring 18 which reacts against a retainer projection 20 formed in the channel 16. The bolt slides along the outer bottom 24 of the pan 10 past a first side 26 of the frame pan 10. The bolt is engageable with a door frame member 22 in the manner illustrated in FIG. 3, and is withdrawable from such engagement in the manner illustrated in FIG. 4.

Figure 4:
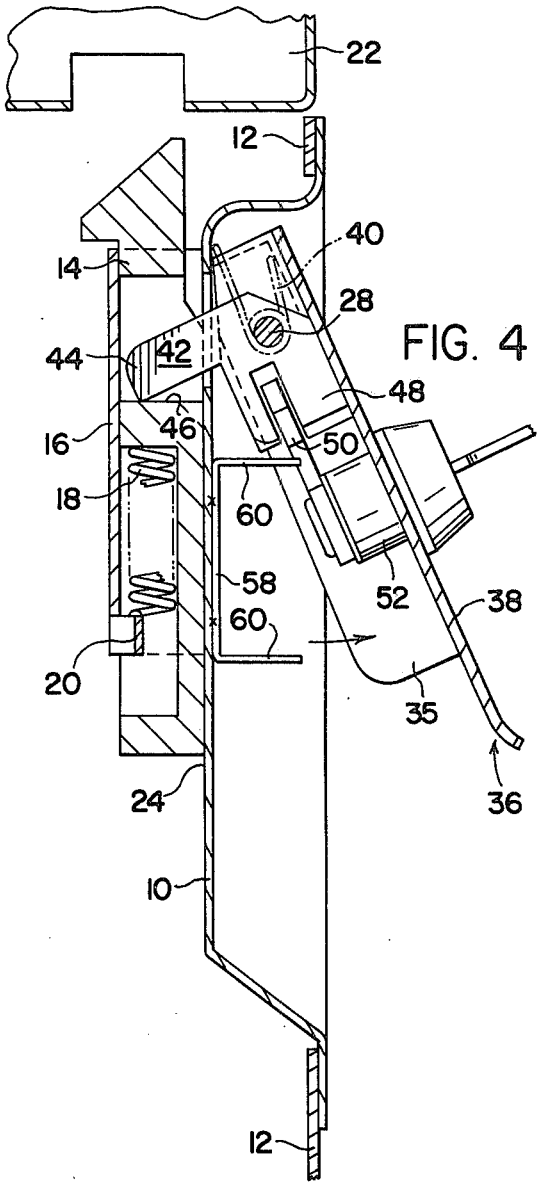
FIG. 4 is a view similar to FIG. 3 showing the opening action of the lock bolt in the unlocked condition.
Figure 5:
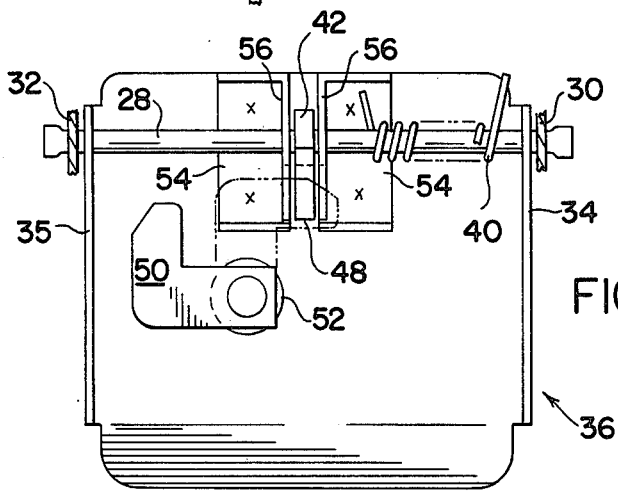
FIG. 5 is a section taken on the plane of line 5—5 in FIG. 3.

A pivot shaft 28 extends between opposed second and third sides 30,32 of the frame pan 10 parallel to and near the first side 26 of the pan. The ends of the shaft 28 may simply be swaged to hold it in position, as shown. A paddle handle 36 (FIG. 4) has top and bottom flanges 34,35 which are pivotally received on the pivot shaft. The front wall 38 of the paddle handle partially covers the pan interior in the normal or closed position of the handle. The handle is biased to normal or closed position by the torsion spring 40 (FIG. 5).

A bellcrank retractor 42 is pivotally mounted on the shaft 28 midway between the top and bottom paddle handle flanges 34,35. A first arm 44 of the retractor extends through the bottom of the pan 10 and is drivingly engageable against a slot face 46 associated with the bolt 14 in the manner best illustrated in FIGS. 3 and 4. The second arm 48 of the bellcrank is drivingly engageable and disengageable by a lug 50 carried by a cylinder lock 52 which is itself carried by the paddle handle 36 and projects from the interior side thereof. The lug 50, as seen in phantom line in FIG. 5, is disengaged from the second arm 48 by rotation of the cylinder lock to the lock position as seen in solid line in FIG. 5. The paddle handle 36 is then free to be moved outwardly against the bias of only the spring 40, and is uncoupled from the bolt 14 and the bias of the bolt spring 18. This uncoupled outward movement is shown in phantom line in FIG. 3. Since the paddle handle is uncoupled from the bolt, no degree of forcing the handle can force the bolt.

The lug 50 is engaged with the arm 48 by rotation of the cylinder lock to the unlock position. In this position, outward movement of the paddle handle retracts the bolt, as shown in FIG. 4.

It will be seen that the lug 50 provides a very simple lock-controlled means for selectively coupling the paddle handle 36 and bellcrank retractor 42 for outward and inward pivoting movement of the bellcrank retractor together with the paddle handle with respect to the frame pan 10, or for leaving the bellcrank retractor uncoupled to the paddle handle during pivoting movement of the paddle handle with respect to the frame pan.

The bellcrank retractor 42 drivingly engages and actuates the bolt 14 in the retracting direction during outward pivoting movement of the paddle handle 36. It thus constitutes the central element of a three element drive train comprising the paddle handle 36, the bellcrank retractor 42, and the bolt 14.

Brackets 54 are welded on the inside of the paddle handle 36 as most clearly seen in FIG. 5. The flanges 56 of these brackets constitute guide plates which guidingly engage the sides of the bellcrank retractor 42, making it unnecessary to key the bellcrank retractor to the pivot shaft 28 or to provide close tolerance for the fit of the retractor on the shaft. The flanges 56 also discourage attempts to tamper with the bellcrank retractor with probing or prying tools. For the same purpose, a bracket 58 having upstanding baffle plates 60 is welded to the bottom of the frame pan 10.

The paddle handle, frame pan, bellcrank, lug, and brackets may all be economically fabricated from sheet or plate stock. In general, the overall structure disclosed can accommodate loose manufacturing tolerances, contributing significantly to manufacturing economy.

Paddle handle lock bolts embodying the invention may vary in details from the illustrative example described above. The invention is not limited to the particulars of this example but is defined by the following claims.

What is claimed is:

1. A paddle handle lock construction including, a pan member constituting a paddle handle frame pan, a spring-loaded bolt mounted on the outer bottom of the frame pan for sliding movement along the outer bottom past a first side of the frame pan, a pivot shaft extending between opposed second and third sides of the frame pan near and parallel to said first side of the frame pan, a paddle handle having a front wall normally partially covering the pan interior and top and bottom flanges extending interiorly of the pan adjacent said opposed second and third sides thereof, each of said flanges being pivotally received on the pivot shaft, a bellcrank retractor pivotally received on the pivot shaft between said paddle handle flanges and having one arm extending through the bottom of the frame pan and drivingly engageable with the bolt, and a second arm drivingly engageable and disengageable by a lug carried by a cylinder lock which itself is carried by and bodily moves with the paddle handle and projects from the interior side thereof, the lug being disengaged from the second arm by rotation of the cylinder lock to lock position and engaged by rotation of the cylinder lock to unlock position, the paddle handle, bellcrank, and sliding bolt comprising a three-element bolt-retraction train in which the first element of the train and the central element of the train, i.e., the paddle handle and the bellcrank, are coupled and uncoupled by said engagement and disengagement of said second arm and said lug to thereby govern actuation of the third element of the train, i.e., the bolt.

2. A construction as in claim 1 in which the bellcrank retractor is pivotally received on the pivot shaft simply by means of a hole in the bellcrank retractor through which the pivot shaft passes, guide plate means fixed to the inside of the front wall of the paddle handle on each side of the bellcrank retractor.

3. A construction as in claim 2, baffle plate means fixed on the inside bottom of the frame pan between the bellcrank retractor and the free end of the paddle handle.

4. In a paddle handle lock bolt, paddle handle frame means and a linkage train comprising a paddle handle and a bellcrank coaxially pivotally mounted on the frame means a sliding spring-loaded bolt, and a lock with lock-controlled coupling means carried on the paddle handle and bodily moving therewith for selectively (1) coupling the paddle handle and bellcrank for coaxial outward and inward pivoting of the bellcrank together with the handle with respect to the frame means in a first position of said lock and coupling means and or (2) leaving the bellcrank uncoupled from the paddle handle during pivoting movement of the handle with respect to the frame means, in a second position of said lock and coupling means the bellcrank drivingly engaging and actuating the bolt along the frame means in the retracting direction during outward pivoting movement of the paddle handle while said lock and coupling means are in the first position, the paddle handle, bellcrank and sliding bolt comprising a three-element bolt-retraction train in which the first element of the train and the central element of the train, i.e., the paddle handle and the bellcrank, are coupled and uncoupled to thereby govern actuation of the third element of the train, i.e., the bolt.

* * * * *